US006429020B1

(12) United States Patent
Thornton et al.

(10) Patent No.: US 6,429,020 B1
(45) Date of Patent: Aug. 6, 2002

(54) FLASHBACK DETECTION SENSOR FOR LEAN PREMIX FUEL NOZZLES

(75) Inventors: Jimmy Dean Thornton; George Alan Richards; Douglas L. Straub; Eric Arnold Liese; John Lee Trader, Jr.; George Edward Fasching, all of Morgantown, WV (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 104 days.

(21) Appl. No.: 09/585,540

(22) Filed: Jun. 2, 2000

(51) Int. Cl.[7] ..... G01N 21/71; G01N 21/72; G01N 30/68; F23N 5/08

(52) U.S. Cl. ..... 436/153; 48/192; 250/374; 250/379; 324/464; 324/468; 422/54; 422/89; 431/7; 431/78; 431/79; 431/90; 431/202; 436/154

(58) Field of Search ..... 48/192; 250/374, 250/379; 422/54, 89; 431/7, 78–79, 90, 202; 324/464, 468; 436/154, 153

(56) References Cited

U.S. PATENT DOCUMENTS

| | | | | | |
|---|---|---|---|---|---|
| 3,399,039 | A | * | 8/1968 | Taft | 422/54 |
| 3,451,780 | A | * | 6/1969 | Prescott et al. | 422/54 |
| 3,473,895 | A | * | 10/1969 | Brittan et al. | 422/54 |
| 3,510,261 | A | * | 5/1970 | Fertig | 422/54 |
| 3,585,003 | A | * | 6/1971 | Scolnick | 422/54 |
| 3,920,401 | A | * | 11/1975 | Gatiss et al. | 422/54 |
| 3,984,205 | A | * | 10/1976 | Karas et al. | 422/54 |
| 4,410,854 | A | * | 10/1983 | Kroneisen et al. | 324/468 |
| 4,568,267 | A | * | 2/1986 | Kendqall-Tobias | 431/90 |
| 4,746,285 | A | * | 5/1988 | Guerra | 431/202 |
| 4,965,048 | A | * | 10/1990 | Ogasawara | 422/54 |
| 5,073,753 | A | | 12/1991 | Collings et al. | |
| 5,095,217 | A | * | 3/1992 | Attix | 250/374 |
| 5,472,337 | A | * | 12/1995 | Guerra | 431/78 |
| 5,667,374 | A | * | 9/1997 | Nucher et al. | 431/7 |
| 5,676,712 | A | * | 10/1997 | Anderson | 48/192 |
| 5,685,139 | A | * | 11/1997 | Mick et al. | 60/776 |
| 5,961,314 | A | * | 10/1999 | Myhre et al. | 431/79 |

FOREIGN PATENT DOCUMENTS

| | | | |
|---|---|---|---|
| DE | 4425304 | * | 2/1996 |
| JP | 57-146154 | * | 9/1982 |
| JP | 2-47547 | * | 2/1990 |
| JP | 9-203724 | * | 8/1997 |
| WO | 96/06349 | * | 2/1996 |

OTHER PUBLICATIONS

ESS Measurement, Instrument Engineers' Handbook, Bela G. Liptak, 1969, pp. 535–539.

* cited by examiner

*Primary Examiner*—Arlen Soderquist
(74) *Attorney, Agent, or Firm*—Mark F. LaMarre; Mark P. Dvorscak; Paul A. Gottlieb

(57) ABSTRACT

A sensor for detecting the flame occurring during a flashback condition in the fuel nozzle of a lean premix combustion system is presented. The sensor comprises an electrically isolated flashback detection electrode and a guard electrode, both of which generate electrical fields extending to the walls of the combustion chamber and to the walls of the fuel nozzle. The sensor is positioned on the fuel nozzle center body at a location proximate the entrance to the combustion chamber of the gas turbine combustion system. The sensor provides 360° detection of a flashback inside the fuel nozzle, by detecting the current conducted by the flame within a time frame that will prevent damage to the gas turbine combustion system caused by the flashback condition.

13 Claims, 5 Drawing Sheets

TYPICAL CONTROL CIRCUIT FOR FLASHBACK DETECTION SENSOR

FLASHBACK DETECTION SENSOR FOR LEAN PREMIX FUEL NOZZLES

BACKGROUND OF THE INVENTION

1. Field of the Invention

The present invention relates to lean premix combustion systems in general, and to the detection of a flashback condition in lean premix fuel nozzles of gas turbine combustion systems in particular.

2. Brief Discussion of the Related Art

Many advanced gas turbine combustion systems use lean premix nozzles in pursuit of lower emissions and higher efficiency. Unfortunately, many of these systems have experienced problems associated with instabilities and flashback. Flashback occurs when the flame normally contained to the combustion zone of the gas turbine combustion system, moves back into the fuel nozzle.

When flashback occurs in the fuel nozzle, the temperatures inside the nozzle rise above the design temperature for the nozzle material causing costly damage. Also, upon occurrence of a severe flashback condition, fragments of the nozzle material, usually metal, tend to pass through the turbine system usually causing severe damage to the turbine blades. This type of failure, regardless of frequency, can be catastrophic in terms of down time, maintenance costs and lost revenue.

In order to prevent such damage, many devices have in the past been used to detect flashback in fuel nozzles. However, all previous devices tend to exhibit undesirable characteristics such as slow response time, and point type or line of site measurements.

For example, thermocouples and bimetallic elements when used as flashback detectors in fuel nozzles, suffer from the disadvantages of providing only localized point measurements and generally slow reaction times (typically 2 to 3 minutes), which can lead to failure of the fuel nozzle before detection. Another disadvantage of these sensors is that, since they only detect heat, they are unable to distinguish between heat generated by the flame of a flashback condition and the heat radiated by the normal combustion process of the gas turbine combustion system.

Similarly, flame rods must be in direct contact with the flame in order to function properly. Unfortunately, it is not always known exactly where in the fuel nozzle of a gas turbine combustion system flashback will occur, and unless the flame rods are in the precise location, flame rods would be useless for detecting the flame occurring during a flashback condition.

Attempts to use radiation type flame sensors as flashback detectors have also been made. For this type of detector, a photocell is used as the actual detector. At least one element of the photocell is coated with a sulfide compound, such as cadmium-sulfide or lead-sulfide, so as to be sensitive to the particular wavelengths of light emitted by a flame occurring during a flashback condition. For instance, the electrical resistance of cadmium-sulfide decrease directly with increasing intensity of light, and like lead-sulfide, will function as a variable resistor. However, when used to detect the presence of a flame, a cadmium-sulfide photocell is useful only for sensing that portion of the flame occurring in the visible light wavelengths. Unfortunately, the cadmium-sulfide photocell will not respond to gas flames, and therefore can only be used to detect the presence of oil flames.

On the other hand, a lead-sulfide photocell provides detection in the infrared wavelength regions. Similar to the cadmium-sulfide photocell, the lead-sulfide photocell can change its resistance inversely to the infrared radiation it is subjected to, and the current flow generated by the lead-sulfide photocell serves as a measure of flame strength. However, the "shimmering effect" caused by movement of hot gases between a refractory surface and the lead-sulfide photocell can erroneously deceive the photocell into indicating the presence of a flame, which makes this type of photocell unreliable for use as a flashback detector.

To overcome these problems, a suitable flashback detector must be able to reliably and dependably detect the flame of a flashback condition anywhere inside the fuel nozzle and provide a clear indication that a flashback condition exists.

It is well known that a flame, being the result of a chemical reaction between a fuel and oxygen, liberates a large number of electrons. Because of this ionization, the flame is capable of conducting an electrical current. Moreover, a flame can conduct both direct and alternating current, either of which could be utilized to establish an electrical circuit.

Conduction occurs when ionization takes place. The electrons that are liberated from the burning fuel and oxygen molecules are free to move about, thus constituting the current. In addition to the freed electrons, a negative electrode properly situated in the vicinity of the flame would in the process of repelling the freed electrons, also would tend to lose some of its own electrons provided that there were a sufficient number of positive ions, such as from a positive electrode, in the vicinity to attract them. Accordingly, the number of electrons leaving the negative electrode and entering the positive electrode determines the rate of current flow. It is apparent that the current flow depends on the number of positive ions that get near enough to the negative electrode. If the area of one electrode is made several times larger than the other, and that electrode is negative, it will accommodate a larger number of positive ions. This in turn will increase the flow of electrons to the positive electrode. Accordingly, an electrode immersed in the flame would act as one electrode and the combustion chamber wall act as the other electrode.

Hence, an electrode strategically placed in a fuel nozzle, in the vicinity of a location likely to experience flashback, will detect the existence of the flame associated with the flashback condition by way of this flame ionization process. Then, an electrical signal produced by the sensor detecting the existence of the flame would in turn be relayed to the various controllers associated with the proper operation of the gas turbine combustion system.

Therefore, advantageous use of flame ionization techniques could be employed to detect the flame present during a flashback condition. A sensor employing these techniques would make an ideal flashback sensor. The responsive nature of the sensor will also facilitate measurements of flame flicker in the nozzle during operation, should they occur.

SUMMARY OF THE INVENTION

It is an object of the present invention to provide a flashback detector for a lean premix combustion system.

It is an additional object of the invention to provide a flashback detector for a lean premix system capable of detecting a flashback condition in a lean premix fuel nozzle.

It is another object of the present invention to provide a flashback detector capable of providing real-time detection of a flame associated with a flashback condition occurring anywhere along the entire length of the fuel nozzle of a combustion system.

It is a further object of the invention to provide a flashback detector that isolates the combustion region of a gas turbine combustion system from the sensor electrode thereby minimizing false indication of flashback.

It is still another object of the invention to provide a reliable flashback detector for a gas combustion system that uses inexpensive electronics and uncomplicated peripheral hardware.

It is yet another object of the invention to provide a flashback detector for a gas turbine combustion system that can easily incorporate the detector in new fuel nozzle designs as well as in existing fuel nozzle designs.

It is yet a further object of the invention to provide detection of flame in the fuel nozzle of a gas turbine combustion system within a time frame that will prevent damage to any part of the gas turbine combustion system.

These and other objects, aspects and advantages will be better understood from the following detailed description of preferred embodiments of the invention with reference to the appended claims.

Basically, the present invention is a system for detecting a flashback condition in a fuel nozzle of a lean premix combustion apparatus. The system comprises a sensor positioned in the fuel nozzle and a control circuit coupled to the sensor. The sensor includes a first electrode and a second electrode held in a coplanar but spaced apart manner by an insulating body. At least a portion of the first and second electrodes are exposed to gases flowing through the fuel nozzle. The control circuit coupled to the first and second electrodes of the sensor is capable both of causing electrical fields to radiate 360° from the electrodes to the walls of the fuel nozzle and the combustion chamber and of receiving from the electrodes an electronic signal indicating the occurrence of a flashback condition in the fuel nozzle. The first and second electrodes can be spaced apart and insulated by a thermoplastic material or by a ceramic material. Preferably, the sensor is centered in the fuel nozzle center body at a location proximate to the combustion chamber of the gas turbine apparatus. Preferably, the fuel nozzle for use with this invention is a lean premix fuel nozzle.

Ideally, the sensor for detecting a flashback condition in a combustion system, comprises first and second electrodes, an electronic circuit, an electrically and thermally insulating body portion having a relatively smooth surface. The first and second electrodes being operably connected to the electronic circuit, and the first and second electrodes being situated on the relatively planar surface of the body portion in a spaced apart and physically isolated relationship one from the other, whereby upon the occurrence of a flashback condition the first and second electrodes will forward to the electronic circuit a signal indicating that the flashback condition exists. Preferably, the sensor is positioned in the fuel nozzle of the gas turbine combustion system. To provide improved performance the sensor is centered near the downstream end of the center body of the fuel nozzle at a location proximate the combustion chamber of the gas turbine combustion system.

The invention also includes a method for signaling a flashback condition in a fuel nozzle of a combustion system using an electronic detector having a sensor electrode and a guard electrode arranged in a coplanar but spaced apart manner on the surface of an insulating detector body, and an electronic detector circuit. The method comprising the steps of; a) locating the detector body on the center body of the fuel nozzle at a location proximate the combustion chamber such that the sensor electrode and the guard electrode are immersed in the fuel/air stream flowing through the fuel nozzle; b)generating electrical fields from each of the sensor electrode and the guard electrode, the electrical fields extending from the face of the sensor electrode to the walls of the fuel nozzle and the electrical fields extending from the face of the guard electrode to the wall of the combustion chamber; and c) monitoring the sensor electrode and the guard electrode with the detector for the completion of an electrical circuit and the occurrence of a flashback condition in the fuel nozzle.

Preferably, the method for detecting a flashback condition in a lean premix fuel nozzle of a gas turbine apparatus using an electronic detector and an electronic detector circuit, the detector having a first electrode and a second electrode arranged in a coplanar but spaced apart manner on the surface of an insulating body. The method comprising the steps of: a) locating the detector on the center body of the fuel nozzle at a location proximate the combustion chamber of the gas turbine apparatus such that the electrodes are immersed in the gaseous stream flowing through the fuel nozzle; b) generating electrical fields from each of the electrodes; and c) monitoring the first and second electrodes with the detector circuit for the completion of an electrical circuit and occurrence of a flashback condition in the fuel nozzle.

The step of generating electrical fields may further comprise causing the electrical field to extend from the face of the first electrode along the entire length of the walls of the fuel nozzle, and causing the electrical field to extend from the face of the second electrode to the wall of the combustion chamber. The first and second electrodes may be so arranged within the nozzle that first electrode is a guard electrode and the second electrode is a sense electrode, and said guard electrode creates a guard electric field region in the combustion chamber at the sensor, such that it prevents normal combustion ionization from producing detectable current at the sense electrode.

DETAILED DESCRIPTION OF THE PREFERRED EMBODIMENT

Figure 1:
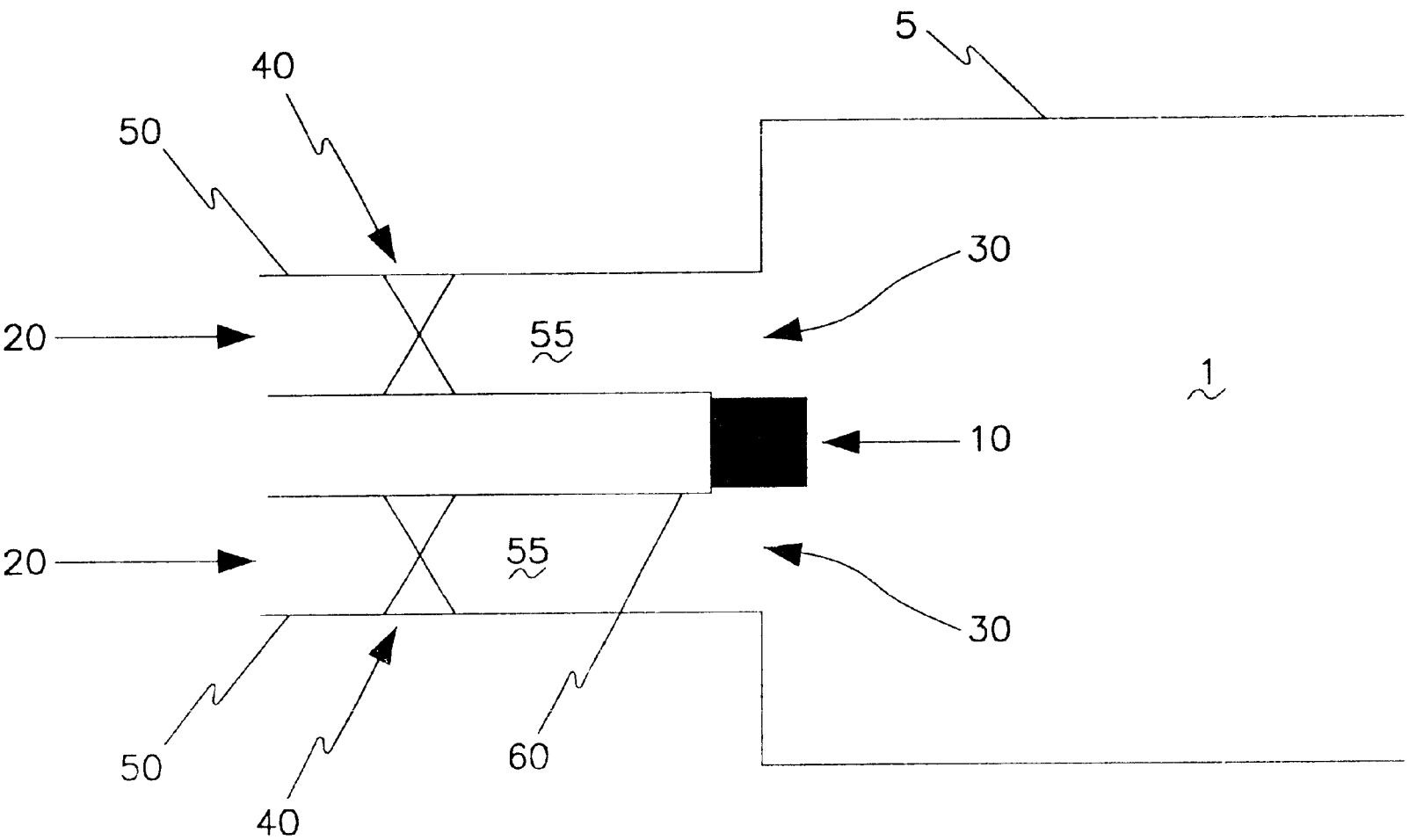
FIG. 1 is an illustration of the present invention situated on the center-body of a typical fuel nozzle of a lean premix combustion system.

Referring to FIG. 1, the flashback sensor of the present invention is denoted by reference numeral 10. Throughout this discussion, the flashback sensor 10 may alternatively be referred to as the sensor, the flashback detector or the detector, all of which in either case are meant to refer to the flashback sensor 10 of the present invention.

Here is a general overview of the structure and function of the invention as shown in a typical gas turbine combustion system within which the present invention is useful. A typical gas turbine combustion system includes a bladed compressor section, one or more combustion chambers, a turbine section comprising one or more bladed turbines, and a fuel/air delivery system. The compressor and the turbine stages are located on a longitudinally extending, rotatable, central axis. If the gas turbine system uses more than one combustion chamber, the combustion chambers are usually situated in a circular array around the central axis. Each combustion chamber serves as a controlled envelope for efficient burning of the fuel/air mixture delivered into it. The fuel/air delivery system takes pressurized air from the compressor section, mixes the air with fuel and then delivers the fuel/air mixture into the combustion chamber for combustion. The outlet end of each combustion chamber is ducted to the inlet section of the turbine section to direct the gaseous exhaust products of the combustion process to the turbine which will then cause the turbine to rotate. The fuel/air delivery system of a typical gas turbine combustion system comprises a plurality of fuel nozzles located downstream from a fuel/air premixing section. At least one fuel nozzle is provided for each combustion chamber. Ignition of the fuel/air mixture within each combustion chamber is achieved by a flame ignitor. During a flashback condition, combustion can occur anywhere upstream or outside of the combustion chamber, usually in the fuel nozzle itself, which of course can cause costly damage to the nozzle.

A cross-section drawing of an exemplary chamber 1 is shown in FIG. 1. This exemplary combustion chamber 1 is deemed to be representative of all such lean premix combustion chambers provided on a combustion system equipped with the flashback sensor 10 of the present invention. Discussion of the sensor 10 of the present invention will be made with respect to this exemplary combustion chamber 1, although each combustion chamber incorporated into the gas lean premix system is to be provided with its own flashback sensor 10. Also for simplicity of discussion, only combustion chamber 1, fuel nozzle 55 and swirl vanes 40 are shown in FIG. 1, without the various other named parts of a gas combustion system mentioned above.

The fuel nozzle 55 is comprised of conducting material and has an inlet section 50 extending from the pre-mixer section (not shown), an outlet port 30 leading into the combustion chamber 1, swirl vanes 40 positioned proximate to the inlet section 50, and a center body 60.

The swirl vanes 40 serve to enhance thorough burning of the fuel/air mixture within the combustion chamber 1 by ensuring that the fuel/air mixture will be completely blended, thereby producing the richest possible combustion.

Air and gaseous fuel are mixed in the pre-mixer section located in an upstream region prior to introduction into the fuel/air inlet 50 through the fuel nozzle 55. The fuel/air mixture 20 is introduced into the fuel nozzle 55 the fuel/air inlet 50. The fuel/air mixture 20 is then injected into the combustion chamber 1 through nozzle outlet ports 30.

Figure 2:
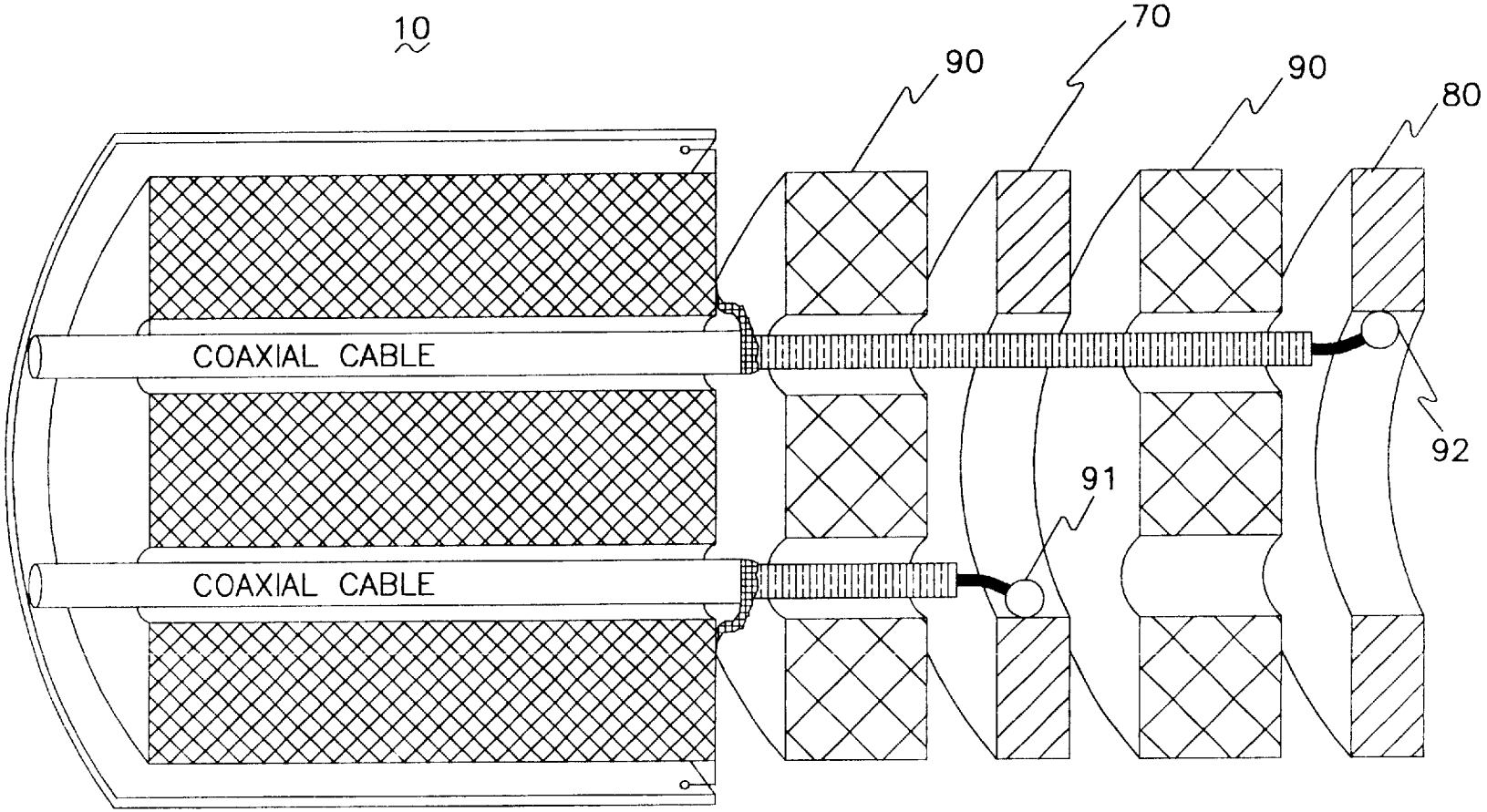
FIG. 2 is a cross-section illustration of the present invention.

The structure of the flashback sensor 10 of the present invention will now be discussed with reference to FIG. 2.

The sensor 10 is made up of three main components, namely a circular sensor electrode 70, a circular guard electrode 80 and a sensor body 90. The electrodes 70 and 80 are made of an electrically conducting material, such as a metal that is capable of withstanding the normal operating temperatures produced in a combustion system. The material should also be able to withstand the high temperatures presented during a flashback condition.

The sensor body 90 is made of a non-conducting but rugged material, such as an engineered thermoplastic or ceramic, that is also able to withstand both the normal operating temperatures produced during combustion in a gas turbine system as well as the high temperatures presented during a flashback condition. The sensor body 90 has a circular shape with a smooth surface. The sensors 70, 80 are securely seated in the body 90 in electrical and physical isolation from one another, but in such manner that a significant portion of the face of each sensor 70, 80 is exposed. The sensors 70, 80 are electrically charged by coaxial cables 91, 92.

The flashback sensor 10 is securely fastened to the nozzle center body 60 within the fuel nozzle 55 at a location downstream from the pre-mixer section of the gas combustion system, but in close proximity to the combustion chamber 1. The sensor body 90 is oriented on the nozzle center body 60 so as to sufficiently immerse the exposed surfaces of the electrodes 70, 80 in the fuel/air stream 20 flowing through the nozzle 55 as the stream 20 flows from the pre-mixer to the combustion chamber 1 such that rapid and precise detection of a flashback condition occurring in the nozzle 55 can be achieved.

Figure 3:
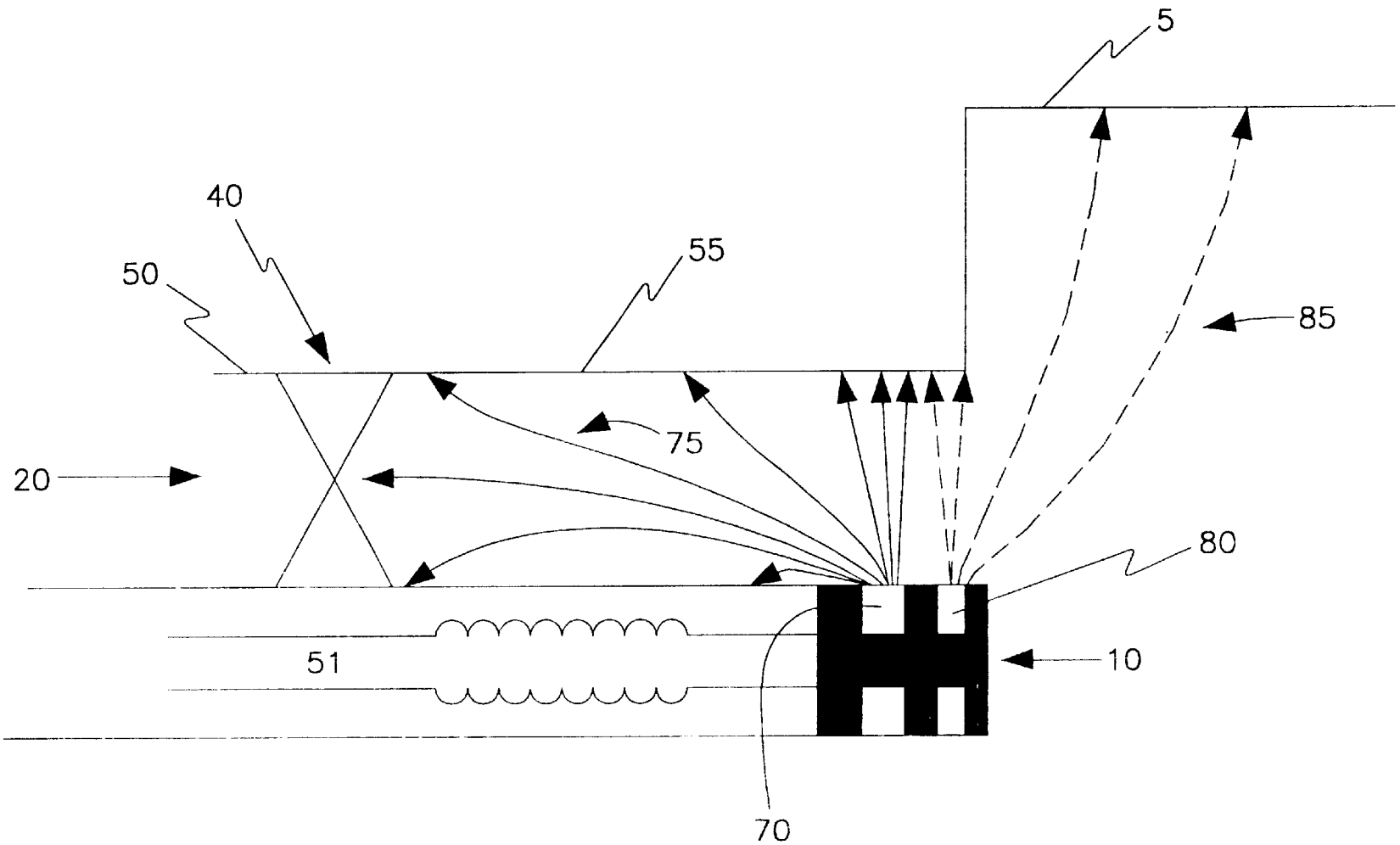
FIG. 3 is a sectional view of the present invention while situated in a typical fuel nozzle of a lean premix combustion system.

FIG. 3 provides a detailed view the fuel nozzle 55 so as to clearly show the lines of electrical fields 75, 85 extending from the electrodes 70, 80 of the sensor 10. The fuel nozzle 55, swirl vanes 40, fuel/air inlet 50, and the combustion chamber wall 5 remain the same as shown and discussed with respect to FIG. 1.

The DC electric fields 75, 85 extend to the combustion chamber wall 5 and the wall of the fuel nozzle 55, which are both made of an electrically conductive material. The lines of electric fields 70, 80 are produced and controlled by a detector circuit 90, as shown in detail in FIG. 5 and discussed herein later, which is ultimately responsible for the control and supervision of the electrodes 70, 80. A detector circuit 90 for each set of electrodes is connected between the electrode and ground by conductors 51 and 52 (For demonstration only one detector circuit is shown). The detector circuit includes a current sensing circuit couple to each of the electrodes 70, 80. The detector circuit is also responsible for indicating to an operator when the sensor 10 has detected the existence of a flashback condition in the fuel nozzle 55.

Figure 5:
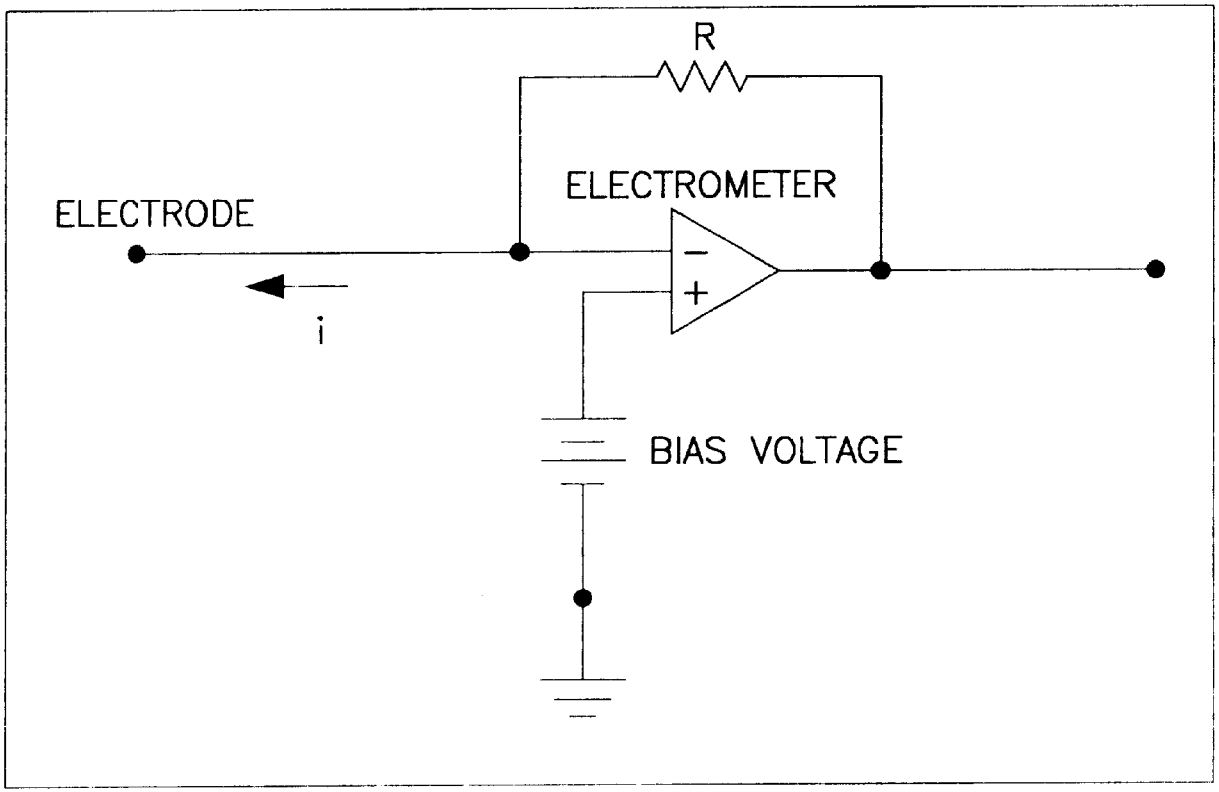
FIG. 5 is a schematic diagram of a flashback detection sensor.

Each electrode will have a separate detector circuit, with equal-potential bias voltage, so the current measured through each electrode is independent of the other. An example of a typical control circuit for the flashback detection sensor is shown in FIG. 5. This circuit supplies a bias voltage to the electrode and measures the current conducted through the electrode. The remainder of the nozzle and combustion chamber are at reference ground potential in respect to the circuit shown in FIG. 5. The electrometer configuration shown in FIG. 5 provides a voltage output proportional to the amount of current conducted through the electrodes, which can be used to signal that a flashback condition has occurred. Other circuits may be used to interface to the flashback sensor electrodes, while maintaining the functionality of the flashback detection sensor.

The sensor system contains two isolated electrodes, the guard electrode 80, and the sense electrode 70. The two electrodes have equal potential voltage, which is at a different potential than that of the remaining combustion system components, which are considered to be at reference ground. Therefore, an electric field 75, 85 is established between the two electrodes 70, 80 and the remaining combustion system components, to include the combustor 5, the fuel nozzle 55, and the remaining center body of the fuel nozzle 56 upstream of the sensor 10. The turbulent flames in the combustion chamber 1 may produce recirculation zones, which can cause ionized gas to recirculate around the face of the nozzle 55. The purpose of the guard electrode 80 is to protect the sense electrode 70 from sensing the current due to the flame in the combustion chamber 1. The equal potential voltage of the two electrodes 70, 80 ensure that the ionization current detected in the combustion chamber 1 is through the guard electrode 80. Once the flame moves into the nozzle 55, past the guard electrode 80, the flame ionization will provide current flow to the sense electrode 70. The electronic circuit will detect this current flow and signal that flashback has occurred.

In cooperation with the electrodes 70, 80, the detection circuit detects the presence of a flame, occurring upon a flashback condition 360° in the electric fields 75, 85. Whereby, any change in the status of the electric fields 75, 85, indicating that an electric circuit is completed between the electrodes 70, 80 and the reference ground (cumbustor 5 and fuel nozzle 55). The detector circuit may further comprise a current amplifying circuit and a processor.The microprocessor may be configured to issue an indication when the current reached from the electrodes 70, 80 reaches a predetermined level. The current generating subcircuit may provide to the electrodes 70, 80 either an alternating current (AC) or direct current (DC).

The invention involves placing two isolated conductive electrodes 70, 80 around the center body of the fuel nozzle at the face of the nozzle, as illustrated in FIG. 3. These electrodes are wired 51 to external electronics (not shown) and the remaining surface of the nozzle 5 is reference ground. An equal potential voltage is applied to these two electrodes 70, 80 establishing a DC current across the entire cross sectional area of the fuel nozzle 55. When a flame enters the fuel nozzle 55, there is a significant increase in ion current inside the nozzle 55. This current is measured using the sensor electrode 70, and used to signal that a flashback has occurred. The impedance of the path spanned by the electric fields 75, 85 between the electrodes 70, 80, respectively, and the wall of the fuel nozzle 55 and the wall of the combustion chamber 5 is affected by the presence of the flame occurring during flashback condition.

Figure 4:
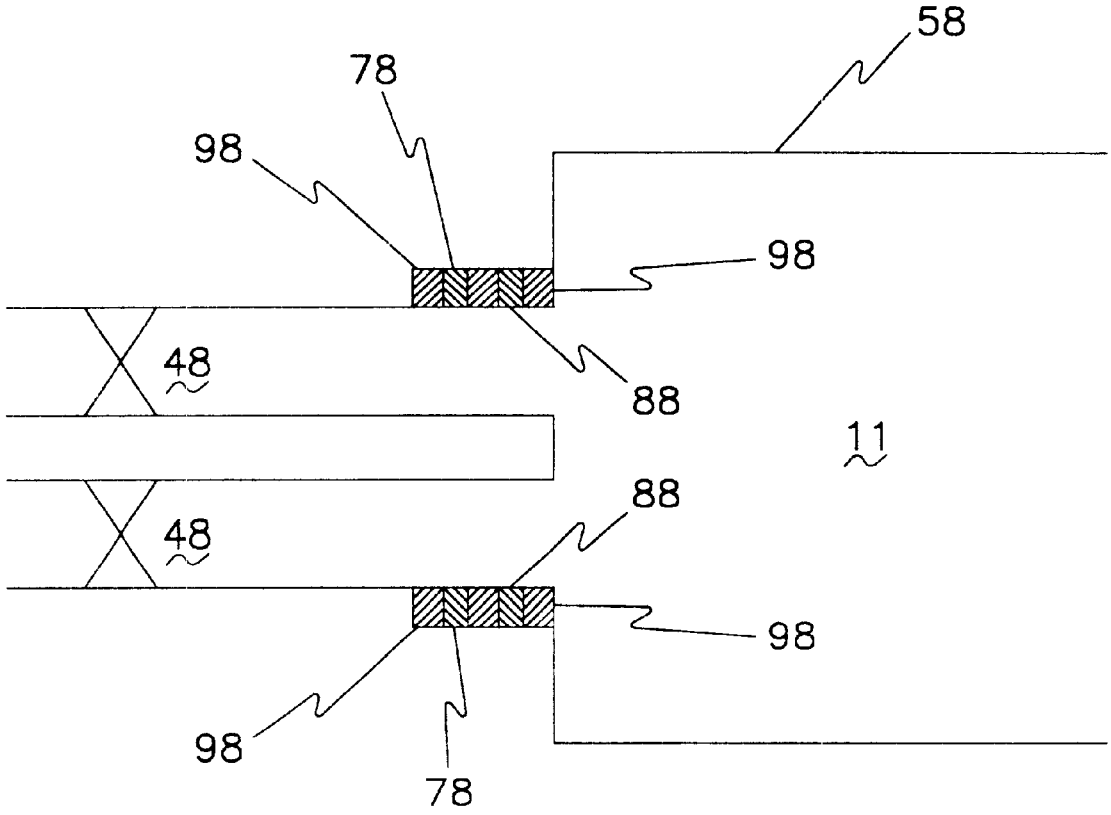
FIG. 4 is an illustration of the present invention on the outer-annulus of a typical fuel nozzle of a lean premix combustion system.

Another embodiment of the invention is shown in FIG. 4. The invention involves placing two isolated conductive electrodes 78, 88 around the body of the fuel nozzle 58 at the face of the nozzle, just after the swirl vanes 48 and before the combustion chamber 11. Non-conducting material 98 surround and isolate each electrode 78, and 88, allowing the invention to operate as the embodiments as described above.

While the invention has been particularly shown and described with reference to a preferred embodiment hereof, it will be understood by those skilled in the art that several changes in form and detail may be made without departing from the spirit and scope of the invention.

What is claimed is:

1. A system for detecting a flashback condition in a fuel nozzle of a lean premix combustion apparatus, the system comprising:

a sensor positioned in the fuel nozzle, said sensor including a first electrode and a second electrode held in a coplanar but spaced apart manner by an insulating body, at least a portion of the first and second electrodes being exposed to gases flowing through the fuel nozzle; and a control circuit coupled to said first and second electrodes, the circuit being capable both of causing electrical fields to radiate 360° from the electrodes to the walls of the fuel nozzle and the combustion chamber and receiving from the electrodes an electronic signal indicating the occurrence of a flashback condition in the fuel nozzle.

2. The system of claim 1, wherein the sensor is centered in the fuel nozzle center body at a location proximate the combustion chamber of the gas turbine apparatus.

3. The system of claim 2, wherein the first and second electrodes are spaced apart and insulated by a thermoplastic material.

4. The system of claim 2, wherein the first and second electrodes are spaced apart and insulated by a ceramic material.

5. The system of claim 1, wherein the fuel nozzle is a lean premix fuel nozzle.

6. A sensor for detecting a flashback condition in a combustion system, the sensor comprising first and second electrodes, an electronic circuit, an electrically and thermally insulating body portion having a relatively smooth surface, the first and second electrodes being operably connected to the electronic circuit, and the first and second electrodes being situated on the relatively planar surface of the body portion in a spaced apart and physically isolated relationship one from the other, whereby upon the occurrence of a flashback condition the first and second electrodes will forward to the electronic circuit a signal indicating that the flashback condition exists.

7. The sensor of claim 6, wherein the sensor is positioned in the fuel nozzle of the gas turbine combustion system.

8. The sensor of claim 7, wherein the sensor is centered near the downstream end of the center body of the fuel nozzle at a location proximate the combustion chamber of the gas turbine combustion system.

9. The sensor of claim 6, wherein the fuel nozzle is a lean premix fuel nozzle.

10. A method for signaling a flashback condition in a fuel nozzle of a combustion system using an electronic detector having a sensor electrode and a guard electrode arranged in a coplanar but spaced apart manner on the surface of an insulating detector body, and an electronic detector circuit, the method comprising the steps of:

locating the detector body on the center body of the fuel nozzle at a location proximate the combustion chamber such that the sensor electrode and the guard electrode are immersed in the fuel/air stream flowing through the fuel nozzle;

generating electrical fields from each of the sensor electrode and the guard electrode, the electrical fields extending from the face of the sensor electrode to the walls of the fuel nozzle and the electrical fields extending from the face of the guard electrode to the wall of the combustion chamber; and monitoring the sensor electrode and the guard electrode with the detector for the completion of an electrical circuit and the occurrence of a flashback condition in the fuel nozzle.

11. A method for detecting a flashback condition in a lean premix fuel nozzle of a gas turbine apparatus using an electronic detector and an electronic detector circuit, the detector having a first electrode and a second electrode arranged in a coplanar but spaced apart manner on the surface of an insulating body, the method comprising the steps of:

locating the detector on the center body of the fuel nozzle at a location proximate the combustion chamber of the gas turbine apparatus such that the electrodes are immersed in the gaseous stream flowing through the fuel nozzle;

generating electrical fields from each of the electrodes; and monitoring the first and second electrode with the detector circuit for the completion of an electrical circuit and occurrence of a flashback condition in the fuel nozzle.

12. The method of claim 11, where the step of generating electrical fields further comprises causing the electrical field to extend from the face of the first electrode along the entire length of the walls of the fuel nozzle, and causing the electrical field to extend from the face of the second electrode to the wall of the combustion chamber.

13. The method of claim 12, where the first electrode is a guard electrode and the second electrode is a sense electrode, and said guard electrode creates a guard electric field region in the combustion chamber at the sensor, such that it prevents normal combustion ionization from producing detectable current at the sense electrode.

* * * * *